United States Patent [19]

Englund et al.

[11] Patent Number: 4,591,867

[45] Date of Patent: May 27, 1986

[54] ATTENUATION APPARATUS FOR AN AERIAL ARRAY

[75] Inventors: Allan H. E. Englund, Älvsjö ; Stefan G. Eriksson, Mönsterås, both of Sweden

[73] Assignee: Telefonaktiebolaget LM Ericsson, Stockholm, Sweden

[21] Appl. No.: 579,016

[22] Filed: Feb. 10, 1984

[30] Foreign Application Priority Data

Feb. 16, 1983 [SE] Sweden ..... 8300860

[51] Int. Cl.[4] ..... H01Q 1/52

[52] U.S. Cl. ..... 343/841; 343/885

[58] Field of Search ..... 343/885, 841, 890, 891

[56] References Cited

U.S. PATENT DOCUMENTS

| | | | |
|---|---|---|---|
| 2,184,940 | 12/1939 | Cork et al. | 343/885 |
| 4,329,690 | 5/1982 | Parker | 343/885 |
| 4,359,743 | 11/1982 | DeSantis | 343/885 |

*Primary Examiner*—Eli Lieberman

*Attorney, Agent, or Firm*—Roberts, Spiecens & Cohen

[57] ABSTRACT

Attenuating apparatus is provided for reducing disturbance between transmitting and receiving aerials mounted vertically one above the other. Attenuation is achieved by a grounded screen (1) and a spacer, both mounted between the aerials. The screen is provided with cutouts (6) having a pitch (c) of $\lambda/2$, where $\lambda$ is the mean frequency of the pertinent frequency band and $\lambda/4$ is the depth (d) of the cutouts. The length of the spacer is $0.70\lambda$.

5 Claims, 4 Drawing Figures

Fig. 2A
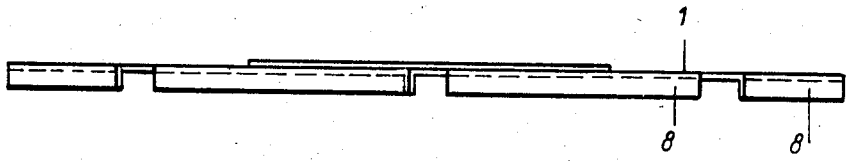
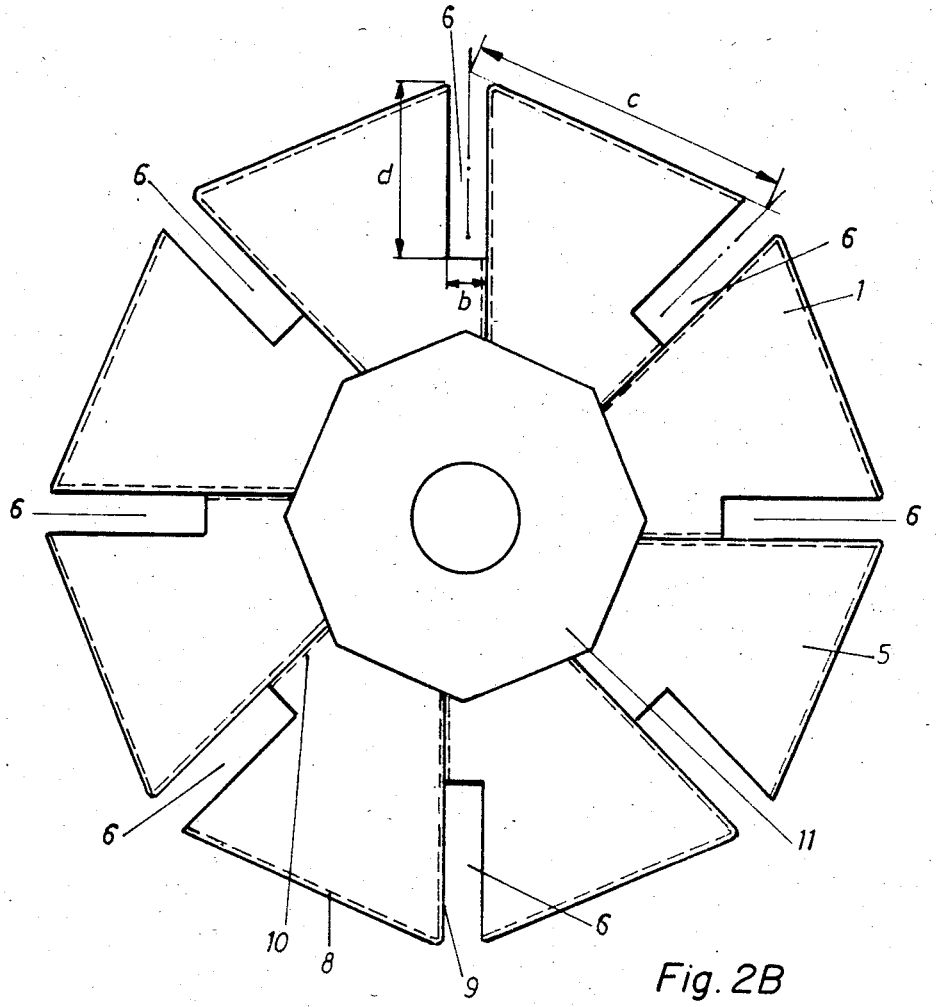
Fig. 2B

ATTENUATION APPARATUS FOR AN AERIAL ARRAY

FIELD OF THE INVENTION

The invention relates to attenuation apparatus intended to attenuate electromagnetic waves between two or more vertically polarized directional aerials placed one above the other for simultaneous operation within the same frequency band.

BACKGROUND

The simultaneous reception and transmission of electromagnetic signals within the same frequency band, with one aerial array for reception and one for transmission is customary, e.g. in central stations for mobile radiotelephony.

Attenuation between two coaxial aerials placed one above the other, operating with vertical polarization within the same frequency band and having average high directivity, has been experimentally determined to be: $A_{dB}=39+25\log(d/\lambda)$, where d is the distance between the aerials and λ is the wavelength in meters.

To obtain a required attentuation of 60 dB between two aerials, according to the aforementioned, without attenuation means between them consequently requires a mutual spacing of about 7 wavelengths.

This spacing between the aerials involves a problem in the design of masts and towers for aerial arrays, inter alia due to the wind resistance caused by the total structure. One method of decreasing this drawback is to introduce spacers and grounded screens between the aerials. Such arrangements are described, e.g. in DT No. 2354550 and corresponding U.S. Pat. No. 3,945,013 and DE No. 2629502 and corresponding U.S. Pat. No. 4,297,707.

SUMMARY OF THE INVENTION

An effective attenuation of electromagnetic waves is obtained by the invention, between aerials placed vertically one above the other and operating within the same frequency band, by placing a grounded screen and a spacer between the aerials to form an attenuation system adapted to the frequency band.

The invention is characterized by the provision of an even number of substantially radially directed cutouts, each having a length of approximately λ/4 and a spacing of approximately λ/2 at the screen periphery between the radially directed center lines of adjacent cutouts. This has the effect of electrically tuning the screen to the mean wavelength λ of the frequency band of operation of the aerials. The spacer has a length of approximately 0.70λ.

BRIEF DESCRIPTION OF THE DRAWINGS

The invention will now be described in detail with reference to the accompanying drawings, wherein FIG. 2A is an elevational view of a screen;

FIG. 2B is a plan view of the screen; and

DETAILED DESCRIPTION OF A BEST MODE FOR CARRYING OUT THE INVENTION

Figure 1:
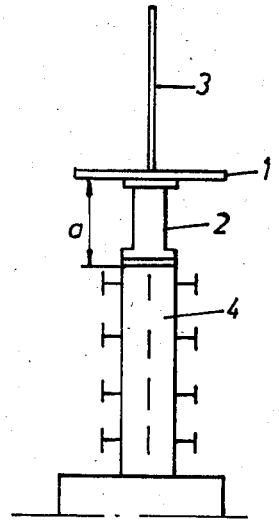
FIG. 1 illustrates, in elevation, an aerial array.
Figure 3:
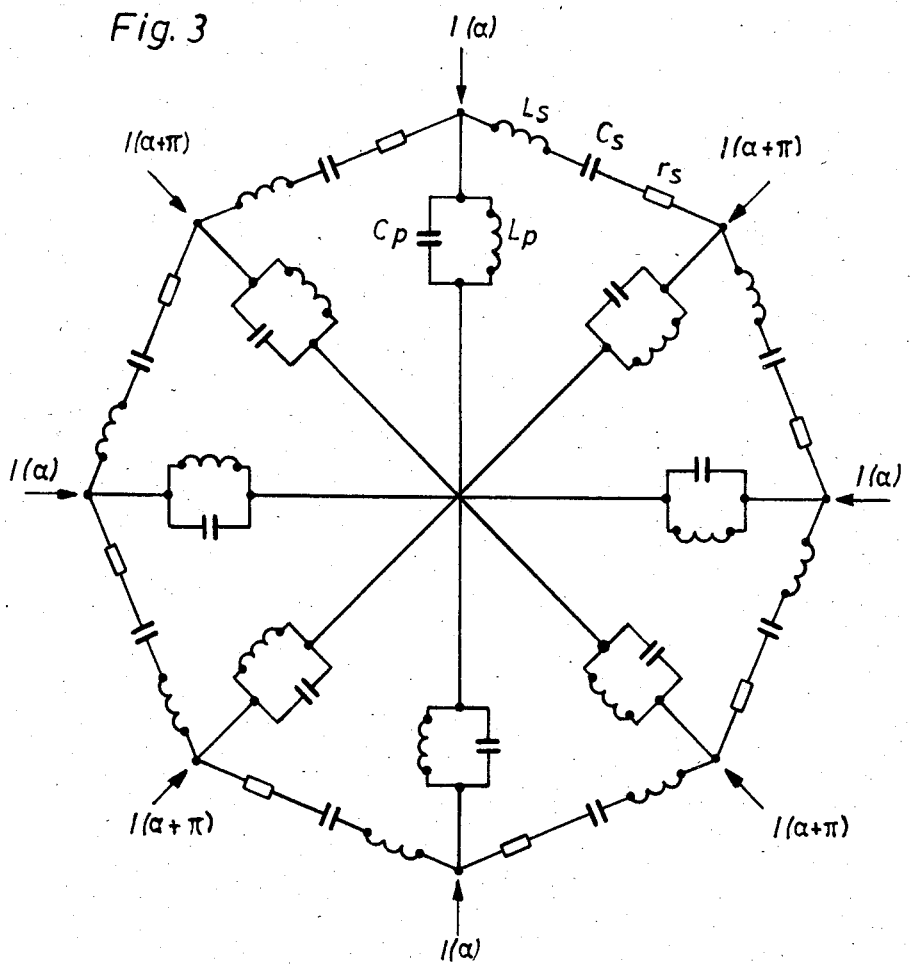
FIG. 3 schematically illustrates an electrical equivalent of the grounded screen.

FIG. 1 illustrates an embodiment of an aerial array provided with an attenuation apparatus in accordance with the invention, in which is seen a grounded screen 1 and a spacer 2 arranged between a receiving aerial 3 and a transmitting aerial 4 having four transmission directions. To utilize the assigned frequency band, in this case 390–470 MHz, effectively, the carrier waves of the transmitters and receivers are spaced only 200 KHz from each other. In consideration of this, and for obtaining maximum attenuation, the screen 1 as well as the spacer 2 have been designed with respect to the mean wavelength λ, which is 0.70 meters in this case. The screen 1 illustrated in FIGS. 2A and 2B consists of eight identical plates 5, attached to a central plate 11. Each of the plates has downwardly folded edge portions 8, 9, 10 for providing stiffness. The edge 10 of each plate is provided with a cutout 6, having a length d of λ/4. The width b of the cutout 6 is determined by the desired bandwidth, as described in detail below. The peripheral pitch c of the plates is λ/2. With the selected dimensions, the screen 1 will be electrically tuned to the wavelength λ. FIG. 3 illustrates the electrical equivalent of the screen 1. As will be seen from FIG. 3, the length d of the cutout corresponds to a parallel resonant circuit, while the pitch length c corresponds to a series resonant circuit. The width b of the cutout corresponds to a resistance in the series resonant circuit, and thus affects the bandwidth of the circuit. In this embodiment the width b has been taken as λ/16, which gives the desired relative bandwidth of about 20%. Tuning the grounded screen results in minimum interfering ground current reaching the central portions of the screen.

The spacer 2 has a length a=0.70λ, since the ground currents between the aerials are at a minimum for aerial distances 0.68λ and 0.72λ, according to measurements carried out.

What is claimed is:

1. Attenuation apparatus for attenuating electromagnetic waves between two vertically polarized directional aerials placed one above the other for simultaneous operation within the same frequency band, said apparatus comprising a grounded screen and spacer disposed one on the other between the aerials, said grounded screen being electrically tuned to the mean wavelength λ of the frequency band of operation of the aerials by the provision of an even number of substantially radially directed cutouts, each having a length of approximately λ/4 and a spacing of approximately λ/2 at the screen periphery, between radially directed pitch center lines of adjacent cutouts, said spacer having a length of approximately 0.70λ.

2. Apparatus as claimed in claim 1 wherein the screen is disposed vertically above the spacer.

3. Apparatus as claimed in claim 1 wherein said cutouts have a width of approximately λ/16 for obtaining a relative bandwidth of approximately 20%.

4. Apparatus as claimed in claim 1 wherein the number of cutouts in the screen is an even multiple of the transmitting directions of the adjacent aerial which serves as a transmitter.

5. Apparatus as claimed in claim 1 wherein the two aerials are a receiving aerial placed above a transmitting aerial, the screen and spacer being disposed between the aerials with the screen on the spacer in proximity to the receiving aerial.

* * * * *